US005651404A

United States Patent [19]

Kraemer et al.

[11] Patent Number: 5,651,404

[45] Date of Patent: Jul. 29, 1997

[54] MULTI-STAGE LOG SPLITTER

[76] Inventors: Daniel J. Kraemer, W. 662 Haf Rd., Genoa City, Wis. 53128; James F. Kraemer, 626 Del Rio, Williamsburg, N. Mex. 87942

[21] Appl. No.: 690,239

[22] Filed: Jul. 19, 1996

[51] Int. Cl.[6] ..... B27L 7/00

[52] U.S. Cl. ..... 144/195.1; 144/193.1; 144/366; 144/4.6

[58] Field of Search ..... 144/4.6, 193.1, 144/195.1, 366

[56] References Cited

U.S. PATENT DOCUMENTS

| | | | |
|---|---|---|---|
| 3,596,691 | 8/1971 | Broad Foot | 144/195.1 |
| 3,779,295 | 12/1973 | Balsbaugh . | |
| 4,081,008 | 3/1978 | Dilling . | |
| 4,380,258 | 4/1983 | Dilling . | |
| 4,503,894 | 3/1985 | Gratkowski . | |
| 4,667,712 | 5/1987 | Hudson et al. | 144/195.1 |
| 4,782,870 | 11/1988 | Duerr . | |
| 4,945,960 | 8/1990 | McCauley | 144/195.1 |

*Primary Examiner*—W. Donald Bray
*Attorney, Agent, or Firm*—Ryan, Maki, Mann & Hohenfeldt, S.C.

[57] ABSTRACT

A wood splitting assembly includes two wood splitting stages mounted on a trailer or truck bed. A first stage for splitting large diameter wood pieces is adapted to be transported in a substantially horizontal orientation to be pivoted to a vertical orientation for use. A horizontal second splitting stage is mounted horizontally. A double stage hydraulic system enables independent reciprocation of the two wood splitting stages independently of each other and is powered by a single motor for driving the hydraulic pump. Preferably a platen at the bottom of the vertical splitting assembly is located a distance from the pivot axis sufficient to engage a level ground surface and thereby to relieve a portion of the weight of the vehicle from a wheel thereof when in a vertical orientation.

5 Claims, 2 Drawing Sheets

MULTI-STAGE LOG SPLITTER

FIELD OF THE INVENTION

This invention relates to log splitters and more specifically to multi-stage log splitters having separate vertical and horizontal splitting stages used in combination.

BACKGROUND OF THE INVENTION

Traditional hydraulically operated log splitters utilize a horizontal ram which reciprocates so that a log being split is forced against a stationary wedge element which effects the splitting. Otherwise the stationary element may be in the nature of a flat surface with the wedge component being reciprocable thereagainst.

It has also been proposed, heretofore, to provide various vertical log splitting device utilizing hydraulic power. In this case the logs can be placed on a stationary element on the ground and a reciprocal splitting element travels vertically downward into the log. This arrangement allows for effective splitting of the logs while minimizing lifting thereof, which is of course is advantageous in the case of the splitting of extremely large diameter logs. See, for example, U.S. Pat. Nos. 3,779,295, 4,081,008, 4,380,258, 4,503,894 and 4,782,870.

SUMMARY OF THE INVENTION

A principal object of the present invention is to provide a log splitter which greatly increases the rate of production of split firewood by a work crew while reducing the physical strain on the workers. In accordance with an important aspect of the invention the log splitter of the present invention utilizes a combination of vertical and horizontal rams. In accordance with a further aspect, both the vertical and horizontal stages of the log splitter of the invention can be operated by a single motor or hydraulic pump.

In accordance with a further aspect of the invention the device includes a vertical ram member which is used, as a first splitting stage, to reduce the size of large logs. The device of the present invention, then, also includes a elevated table onto which the somewhat reduced size pieces of wood are deposited and from which the pieces are fed into a further, horizontal ram for further splitting to the final desired size. In accordance with a related aspect of the invention the elevated placement of the final log splitting stage effects a great reduction in back sprain experienced by the splitter operator as well as increasing the rate of output which can be accomplished.

In accordance with yet another aspect of the invention, a vertical splitting stage is provided which is configured so that the bottom support element against which the logs are split is firmly and effectively supported by a base ground surface. In accordance with a further related aspect the vertical splitter component is pivotally mounted on the bed of a vehicle such as a truck or trailer and can be pivoted from a horizontal position to a vertical operating position. In a preferred embodiment, the pivot point for the vertical splitter component is at the same elevation as the table on which the horizontal component is mounted.

In accordance with yet a further related aspect the lower end of the vertical component is configured so that the distance between the pivot point and the base of the splitter slightly exceeds the distance between the bottom of a tire supporting the vehicle and the elevation of the pivot point.

A wood splitting assembly includes two wood splitting stages mounted on a trailer or truck bed. A first stage for splitting large diameter wood pieces is adapted to be transported in a substantially horizontal orientation to be pivoted to a vertical orientation for use. A horizontal second splitting stage is mounted horizontally. A double stage hydraulic system enables independent reciprocation of the two wood splitting stages independently of each other and is powered by a single motor for driving the hydraulic pump. Preferably a platen at the bottom of the vertical splitting assembly is located a distance from the pivot axis sufficient to engage a level ground surface and thereby to relieve a portion of the weight of the vehicle from a wheel thereof when in a vertical orientation. Further objects and advantages will be apparent from the attached claims, the following detailed description and the accompanying drawings.

DETAILED DESCRIPTION

Figure 1:
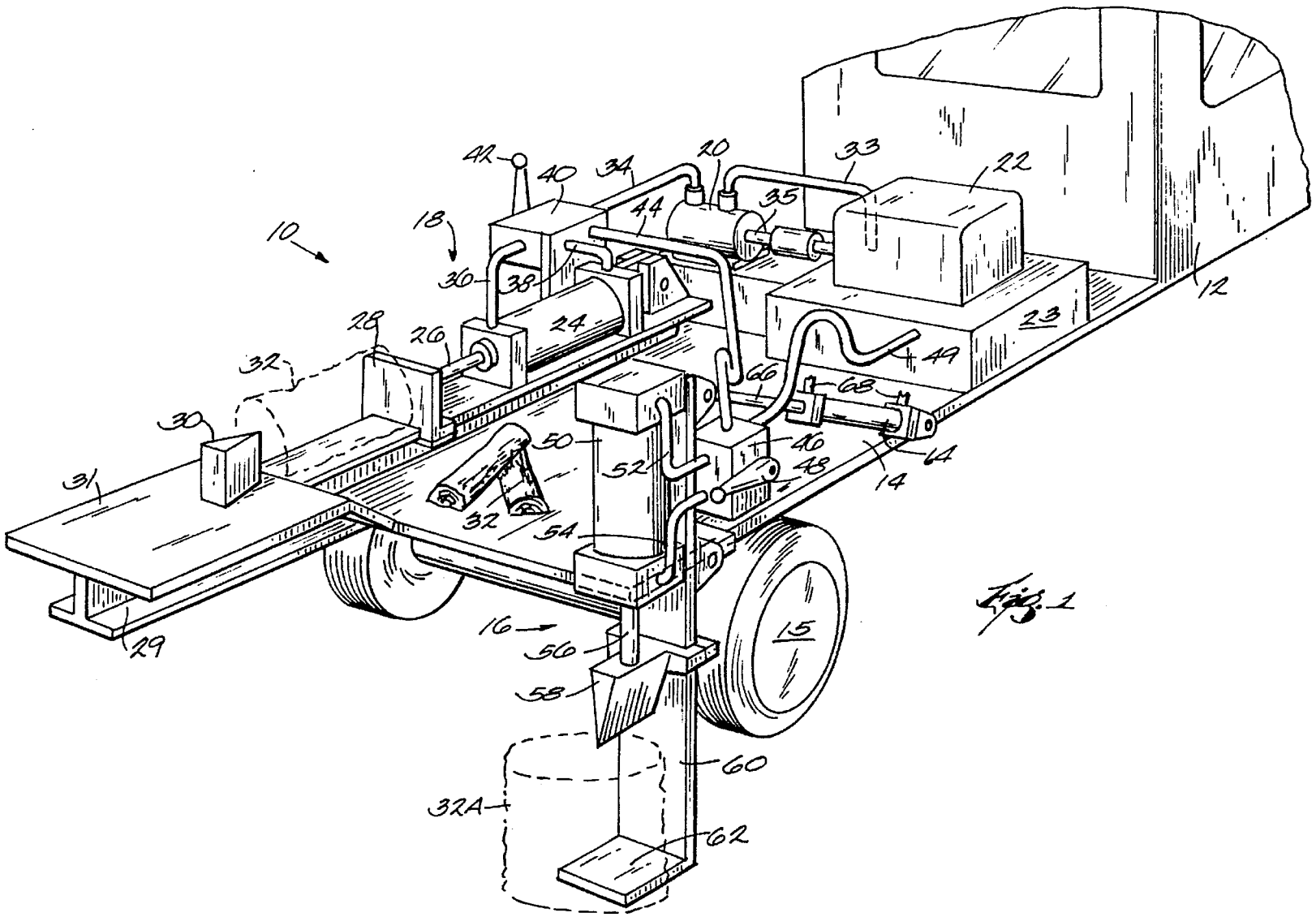
FIG. 1 is a perspective view showing a splitter assembly of the present invention mounted on a truck.

Referring more particularly to the drawings the log splitter assembly of the present invention is indicated generally by numeral 10. In the illustrated embodiment motor truck 12 has a flatbed cargo portion 14 upon which assembly 10 is mounted. Assembly 10 can similarly be mounted on a trailer which is towable behind a motor vehicle. Assembly 10 is formed of a vertical splitter component 16 and a horizontal splitter component 18.

One double stage hydraulic pump 20 is used to operate both the vertical splitter 16 and the horizontal splitter 18. Splitter 18 includes a horizontally oriented hydraulic ram 24 which extends and retracts a piston rod 26, which in turn extends and retracts a platen 28 adapted to push a piece of wood 32 against a sharpened wedge 30. The horizontal splitter mechanism 18 is preferrably supported on an I-beam 29 which serves to provide a stable support for the horizontal splitter 18. A platform 31 preferrably supports wedge 30 and provides a supporting surface for the resultant split pieces of wood 32 as they emerge from the splitting wedge 30.

An appropriate hydraulic line 34 conveys pressurized hydraulic fluid from pump 20 to a valve 40 which is provided with an actuator handle 42 provided to control and direct the flow of hydraulic fluid through hydraulic lines 36 and 38 to cylinder 24 in order to retract or extend the piston rod 26. It is essential that valve 40 be of the so called "power-beyond" type, which enables providing of pressurized hydraulic fluid both to cylinder 24 and to a hydraulic line 44 which leads from the horizontal splitter assembly 18 to vertical splitter assembly 16. Superior results are provided by use of a valve having relatively large fluid flow openings, for example, 1.5 inches in diameter.

Hydraulic line 44, thus, enables the flow of pressurized hydraulic fluid to a second valve chamber 46 which is provided with an acutating lever 48. Valve 46 actuates the flow of fluid into cylinder 50 which operates the vertical splitter component 16. Cylinder 50 is provided with a piston rod 56 which is moved downwardly by flow of pressurized hydraulic fluid into the top of cylinder 50 through a hydraulic line 52. Rod 56 is retracted by the flow of hydraulic fluid through a second hydraulic line 54 into the bottom of cylinder 50.

Vertically oriented splitter 16 includes a wedge 58 which is moved upwardly and downwardly by piston rod 56.

Figure 2:
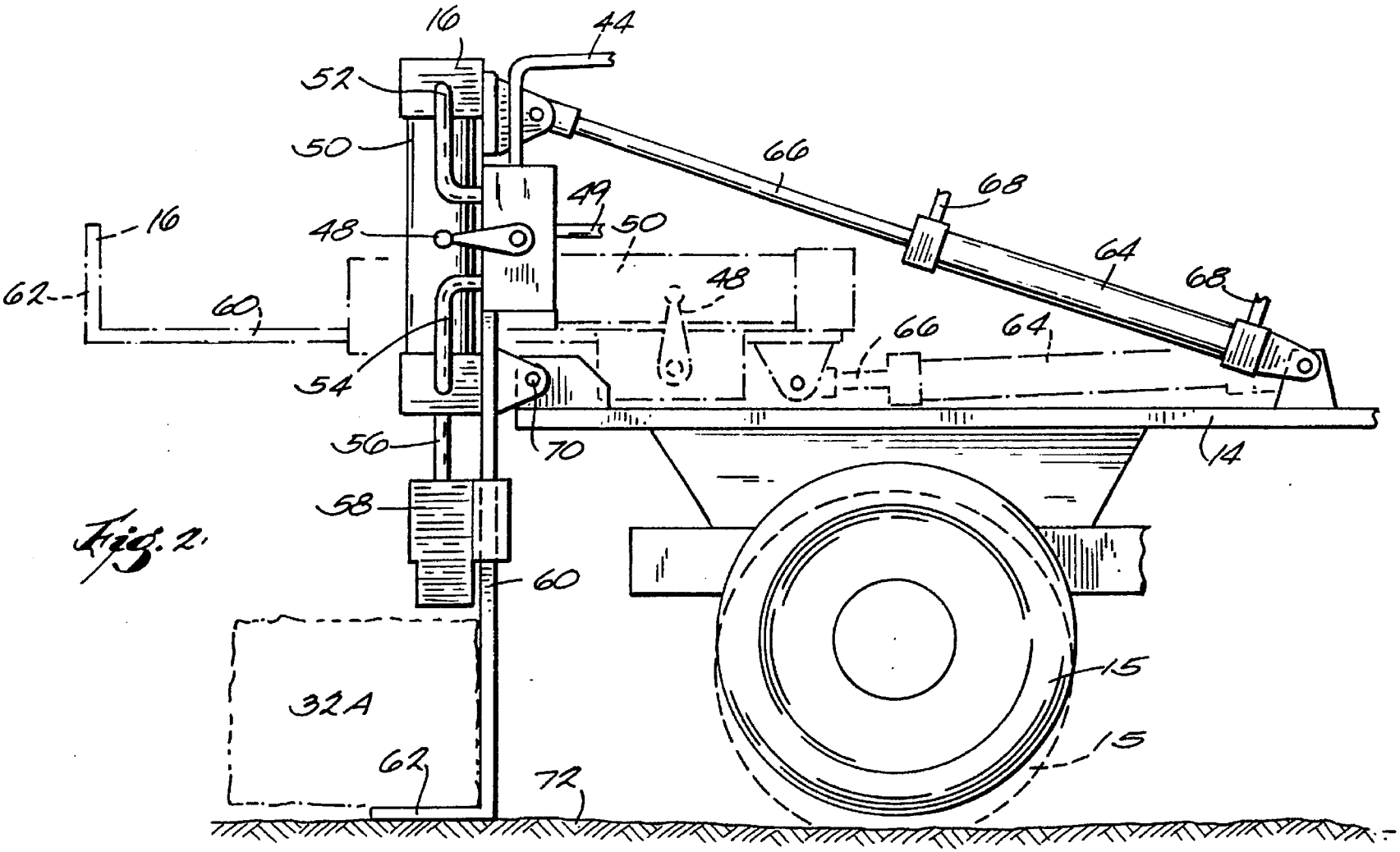
FIG. 2 is a fragmentary side view of part of the assembly of FIG. 1 with a transport position for a vertical splitter component shown by phantom lines.

Wedge 58 is slidably mounted on linear supporting member 60 which may be a flattened steel plate, as shown, or more preferably, an I-beam. At the lower end of linear member 60 is a bottom supporting plate 62 which is integral with and oriented at 90° relative to linear member 60. As best seen in FIG. 2 bottom plate 62 supports a block of wood 32 during splitting by downward motion of wedge 58.

A separate hydraulic cylinder 64, fitted with a piston rod 66 which is actuated by hydraulic pressure provided through hydraulic hoses 68, is utilized to pivot vertical member 16 about a pivot pin 70. Shown by phantom lines in FIG. 2, splitter assembly 16 pivots to a substantially horizontal position for transport and is returned to the vertical orientation for use.

Hinge pin 70 and linear member 60 are dimensioned so that, when pivoted to the vertical position, some of the weight of truck 12 will be supported by member 60 and bottom plate 62 thus assuring firm engagement of plate 62 with the ground surface 72. This assures a solid backing for large block of wood 32A during the splitting process. In FIG. 2 the wheel 15 is shown in a somewhat exaggerated elevated position. Preferably the tire 15 would firmly contact ground surface 72 but some portion of the weight normally applied thereto would be relieved by the transfer of a portion of that weight to linear member 60.

Flow line 49 returns hydraulic fluid to a reservoir 23 from which it is drawn back into the system through a line 33 which is connected to pump 20. As noted a single engine 22 is thus suitable for operating both stages of the log splitting assembly of the present invention as well as the pivoting of vertical splitter 16 to and from the horizontal transport position.

In operation the assembly of the present invention can readily be transported on the vehicle on which it is mounted to a desired location for use. By means of the cylinder 64 the vertical assembly 16 can be pivoted toward an upright position. To the degree necessary, vertical assembly 16 is aided in positioning to the fully upright orientation by backing up the vehicle as assembly 16 is lowered.

In use any large logs 32A can be divided into smaller components which then can be readily lifted onto the flatbed 14. The final size reduction of the firewood is then carried out using the horizontal splitting assembly 18. Due to the fact that the horizontal slitter assembly 18 is at a convenient height, bending and stooping by the operator is eliminated. A high rate of production is thus achievable in accordance with the invention without the degree of fatigue of back strain normally associated with the use of prior art splitter devices.

While specific embodiments of the invention have been shown for purposes of illustration, it will be understood that those skilled in the art may make various modifications. Thus the scope of the invention should be determined by review of the appended claims including reasonable equivalents thereof.

What is claimed is:

1. A wood splitting assembly comprising, in combination, first and second wood splitting stages mounted on a supporting surface of a transporting vehicle, including a first splitting assembly adapted for splitting large diameter wood pieces and adapted to be transported in a substantially horizontal orientation and to be pivoted to a substantially vertical orientation for use about a pivot axis located adjacent to said supporting surface, a horizontal second splitting assembly mounted horizontally on said supporting surface, a double stage hydraulic system enabling reciprocation of said two wood splitting assemblies independently of each other, said hydraulic system including a hydraulic pump powered by a single motor for driving both stages of the hydraulic pump.

2. A device according to claim 1 wherein a platen at the bottom of said vertical splitting assembly is located a distance from the pivot axis sufficient to engage a level ground surface and thereby to relieve a portion of weight of said vehicle from a wheel thereof when said first splitting assembly is in a vertical orientation.

3. A device according to claim 1 wherein pressurized hydraulic fluid is supplied through a fluid flow conduit to a control valve on said horizontal splitting assembly, a valve is provided thereon enabling simultaneous flow of said pressurized hydraulic fluid to said vertical splitting stage, and a further fluid flow conduit connects said valve with a control for said vertical splitting stage.

4. A device according to claim 1 wherein a wood supporting platform is provided at substantially the same elevation as said horizontal splitting stage.

5. A device according to claim 1 wherein wherein each of said splitting assemblies include at least one platen reciprocal along a supporting beam.

* * * * *